US008894924B2

(12) United States Patent
Matsuhashi et al.

(10) Patent No.: US 8,894,924 B2
(45) Date of Patent: Nov. 25, 2014

(54) FERRITE STAINLESS STEEL WITH LOW BLACK SPOT GENERATION

(75) Inventors: Tooru Matsuhashi, Shunan (JP); Michio Nakata, Hikari (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 11 days.

(21) Appl. No.: 13/138,237

(22) PCT Filed: Feb. 5, 2010

(86) PCT No.: PCT/JP2010/000712
§ 371 (c)(1),
(2), (4) Date: Jul. 21, 2011

(87) PCT Pub. No.: WO2010/090041
PCT Pub. Date: Aug. 12, 2010

(65) Prior Publication Data

US 2011/0280760 A1 Nov. 17, 2011

(30) Foreign Application Priority Data

Feb. 9, 2009 (JP) ..... 2009-027828
Feb. 1, 2010 (JP) ..... 2010-020244

(51) Int. Cl.

| | |
|---|---|
| ***C22C 38/28*** | (2006.01) |
| ***C22C 38/24*** | (2006.01) |
| ***C22C 38/00*** | (2006.01) |
| ***C22C 38/04*** | (2006.01) |
| ***C22C 38/06*** | (2006.01) |
| ***C22C 38/26*** | (2006.01) |
| ***C22C 38/22*** | (2006.01) |
| ***C22C 38/02*** | (2006.01) |

(52) U.S. Cl.

CPC ..... *C22C 38/28* (2013.01); *C22C 38/002* (2013.01); *C22C 38/04* (2013.01); *C22C 38/06* (2013.01); *C22C 38/001* (2013.01); *C22C 38/26* (2013.01); *C22C 38/22* (2013.01); *C22C 38/02* (2013.01)

USPC ..... 420/41; 420/70; 420/68; 420/69; 420/60; 420/61; 420/62; 420/63; 420/64

(58) Field of Classification Search

USPC ..... 148/325; 420/60–63, 67, 68, 70
See application file for complete search history.

(56) References Cited

U.S. PATENT DOCUMENTS

2005/0173033 A1 8/2005 Yazawa et al.

FOREIGN PATENT DOCUMENTS

| | | |
|---|---|---|
| CN | 1715437 | 1/2006 |
| JP | 55-021102 | 6/1980 |

(Continued)

OTHER PUBLICATIONS

Machine-English translation of Japanese patent 2006-263811, Yano Hiroshi et al., Oct. 5, 2006.*

(Continued)

*Primary Examiner* — Deborah Yee
(74) *Attorney, Agent, or Firm* — Kenyon & Kenyon LLP

(57) ABSTRACT

This ferrite stainless steel includes: by mass %, C: 0.020% or less; N: 0.025% or less; Si: 1.0% or less; Mn: 0.5% or less; P: 0.035% or less; S: 0.01% or less; Cr: 16% to 25%; Al: 0.15% or less; Ti: 0.05% to 0.5%; and Ca: 0.0015% or less, with the balance being Fe and inevitable impurities, wherein the following formula (1) is fulfilled, $$BI=3Al+Ti+0.5Si+200Ca\leq 0.8 \quad (1)$$

(wherein Al, Ti, Si, and Ca in the formula (1) represent contents (mass %) of the respective components in the steel).

6 Claims, 3 Drawing Sheets

(56) References Cited

FOREIGN PATENT DOCUMENTS

| | | | |
|---|---|---|---|
| JP | 56-146859 | | 11/1981 |
| JP | 05-070899 | | 3/1993 |
| JP | 07-034205 | | 2/1995 |
| JP | 8-144021 | | 6/1996 |
| JP | 10-102212 | | 4/1998 |
| JP | 2002-129292 | | 5/2002 |
| JP | 2004-84067 | | 3/2004 |
| JP | 2004-131796 | | 4/2004 |
| JP | 2004-149833 | | 5/2004 |
| JP | 2006-089814 | | 4/2006 |
| JP | 2006-241564 | | 9/2006 |
| JP | 2006-263811 | * | 10/2006 |
| JP | 2007-270290 | | 10/2007 |
| JP | 2008-231542 | | 10/2008 |

OTHER PUBLICATIONS

Machine-English translation of Japanese patent 08-144021, Jun. 4, 1996, Yamagishi Akihito et al.*

Machine-English translation of Japanese patent No. 2008-231542, Sakitani Misa et al., Oct. 2, 2008.*

International Search Report dated May 18, 2010 issued in corresponding PCT Application No. PCT/JP2010/000712.

Chinese Office Action, dated Nov. 2, 2012, issued in corresponding Chinese Application No. 201080006733.6, and an English translation thereof.

Japanese Notification (Information Statement), dated Feb. 12, 2013, issued in corresponding Japanese Application No. 2010-020244, and a partial English translation thereof.

* cited by examiner (a)

(b)

(a)

(b)

FERRITE STAINLESS STEEL WITH LOW BLACK SPOT GENERATION

TECHNICAL FIELD

The present invention relates to a ferrite stainless steel with low black spot generation in TIG welded portions.

This application is a national stage application of International Application No. PCT/JP2010/000712, filed Feb. 5, 2010, which claims priority to Japanese Patent Application No. 2009-027828 filed on Feb. 9, 2009 and Japanese Patent Application No. 2010-20244 filed on Feb. 1, 2010, and the contents of which are incorporated herein by reference.

BACKGROUND ART

Generally, a ferrite stainless steel has characteristics such as excellent corrosion resistance, a low thermal expansion coefficient in comparison to an austenite stainless steel, excellent stress corrosion cracking resistance, and the like. Therefore, the ferrite stainless steel is widely used for dishes, kitchen utensils, exterior construction materials including roofing materials, materials for cold and hot water storage, and the like. Furthermore, in recent years, due to a steep increase in the price of Ni raw materials, the demand for replacing austenite stainless steels has been increasing; and therefore, the ferrite stainless steel has been used in a wider range of applications.

With regard to structures made of such a stainless steel, welding is an indispensable process. Originally, since the ferrite stainless steel had small solid solubility limits of C and N, the ferrite stainless steel had a problem in which sensitization occurred in welded portions and thus corrosion resistance was degraded. In order to solve the problem, a method has been suggested in which the amounts of C and N are reduced or a stabilization element such as Ti, Nb, or the like is added; and thereby, C and N are fixed so as to suppress sensitization in weld metal zones (for example, Patent Document 1), and this method has been widely put into practical use.

In addition, with regard to the corrosion resistance in welded portions of a ferrite stainless steel, it is known that the corrosion resistance is degraded in scale zones which are generated by heat input during welding; and therefore, it is important to sufficiently perform shielding with an inert gas in comparison to an austenite stainless steel.

Patent Document 2 discloses a technology in which Ti and Al are added at contents that fulfill the formula, $P1=5Ti+20(Al-0.01)\geq 1.5$ (Ti and Al in the formula indicate the contents of respective elements in a steel); and thereby, an Al oxide film that improves the corrosion resistance in weld heat-affected zones is formed in the surface layer of a steel during welding.

Patent Document 3 discloses a technology in which a certain amount or more of Si is added together with both of Al and Ti; and thereby, the crevice corrosion resistance in welded portions is improved Patent Document 4 discloses a technology in which $4Al+Ti\leq 0.32$ (Al and Ti in the formula indicate the contents of respective elements in a steel) is fulfilled; and thereby, heat input during welding is reduced so as to suppress the generation of scales in welded portions; and as a result, the corrosion resistance in welded portions is improved.

The above-described technologies in the related art aim to improve the corrosion resistance in the welded portions or the weld heat-affected zones.

In addition to the above technologies, as a technology to improve the weather resistance and the crevice corrosion resistance of a material itself instead of those of the welded portions, there is a technology in which P is added in a positive manner and appropriate amounts of Ca and Al are added (for example, Patent Document 5). In Patent Document 5, Ca and Al are added so as to control the shape and distribution of non-metallic inclusions in a steel. Here, the most peculiar point of Patent Document 5 is the addition of more than 0.04% of P, and there is no description of the effects during welding in Patent Document 5.

In a ferrite stainless steel in the related art, even when shielding conditions on welded portions are optimized, there are cases where black dots which are generally called as black spots or slag spots are scattered on weld back beads after welding. The black spot is formed by oxides of Al, Ti, Si, and Ca, which have a strong affinity to oxygen, solidified on a weld metal during the weld metal is solidified in a tungsten inert gas (TIG) welding. The generation of black spots is greatly affected by welding conditions, particularly, the shielding conditions of an inert gas, and the more insufficient the shielding is, the more black spots are generated.

Here, since the black spot is an oxide, there is no problem on the corrosion resistance and the formability of welded portions even when a small number of black spots are scattered. However, if a large number of black spots are generated or black spots are generated continuously, the appearance of welded portions is impaired in the case where the welded portions are used without being polished, and in addition, there are cases where black spot portions are separated when the welded portions are processed. In the case where the black spot portions are separated, there are cases where problems occur in which the formability is degraded, and crevice corrosion occurs in gaps between the separated black spot parts. In addition, even when no process is performed after welding, in the case where thick black spots are generated in products in which a stress is applied to welded portions because of its structure, there are cases where the black spots are separated; and thereby, the corrosion resistance is degraded.

As a result, in order to improve the corrosion resistance of TIG welded portions, it is important not only to simply improve corrosion resistance of weld bead zones and weld scale zones, but also to control black spots that are generated in the welded portions. With regard to scales involving discoloration which occurs during welding, it is possible to suppress the majority of the scales by a method in which shielding conditions of welding are enhanced. However, with regard to black spots generated in TIG welded portions, in the related art, it is not possible to sufficiently suppress the black spots even when the shielding conditions are enhanced.

PRIOR ART DOCUMENTS

Patent Documents

Patent Document 1: Japanese Examined Patent Application Publication No. S55-21102

Patent Document 2: Japanese Unexamined Patent Application Publication No. H05-70899

Patent Document 3: Japanese Unexamined Patent Application Publication No. 2006-241564

Patent Document 4: Japanese Unexamined Patent Application Publication No. 2007-270290

Patent Document 5: Japanese Unexamined Patent Application Publication No. H07-34205

DISCLOSURE OF THE INVENTION

Problems to be Solved by the Invention

The present invention has been made in consideration of the above circumstances, and the present invention aims to provide a ferrite stainless steel in which black spots are hard to generate in TIG welded portions and which has excellent corrosion resistance of welded portions and excellent formability of welded portions.

Means for Solving the Problems

In order to suppress the generation amount of black spots, the inventors of the present invention conducted intensive studies as below. As a result, the inventors found that it is possible to suppress the generation of black spots in TIG welded portions by optimizing the amounts of Al, Ti, Si, and Ca; and thereby, the ferrite stainless steel with low black spot generation of the present invention was attained.

The features of the present invention are as follows.

(1) A ferrite stainless steel with low black spot generation in welded portions includes, by mass %, C: 0.020% or less, N: 0.025% or less, Si: 1.0% or less, Mn: 0.5% or less, P: 0.035% or less, S: 0.01% or less, Cr: 18.0% to 25%, Al: 0.03% to 0.15%, Ti: 0.05% to 0.5%, and Ca: 0.0015% or less with the balance being Fe and inevitable impurities, wherein the following formula (1) is fulfilled.

$$BI=3Al+Ti+0.5Si+200Ca\leq 0.8 \quad (1)$$

(wherein Al, Ti, Si, and Ca in the formula (1) represent contents (mass %) of the respective components in a steel).

(2) The ferrite stainless steel with low black spot generation in welded portions according to the above (1), wherein the ferrite stainless steel further includes, by mass %, Nb: 0.6% or less.

(3) The ferrite stainless steel with low black spot generation in welded portions according to the above (1) or (2), wherein the ferrite stainless steel further includes, by mass %, Mo: 3.0% or less.

(4) The ferrite stainless steel with low black spot generation in welded portions according to any one of the above (1) to (3), wherein the ferrite stainless steel further includes, by mass %, either one or both of Cu: 2.0% or less and Ni: 2.0% or less.

(5) The ferrite stainless steel with low black spot generation in welded portions according to any one of the above (1) to (4), wherein the ferrite stainless steel further includes, by mass %, either one or both of V: 0.2% or less and Zr: 0.2% or less.

(6) The ferrite stainless steel with low black spot generation in welded portions according to any one of the above (1) to (5), wherein the ferrite stainless steel further includes, by mass %, B: 0.005% or less.

Effects of the Invention

In accordance with the present invention, it is possible to provide a ferrite stainless steel in which black spots are hard to generate in TIG welded portions and which has excellent corrosion resistance of welded portions and excellent formability.

BEST MODE FOR CARRYING OUT THE INVENTION

Figure 1:
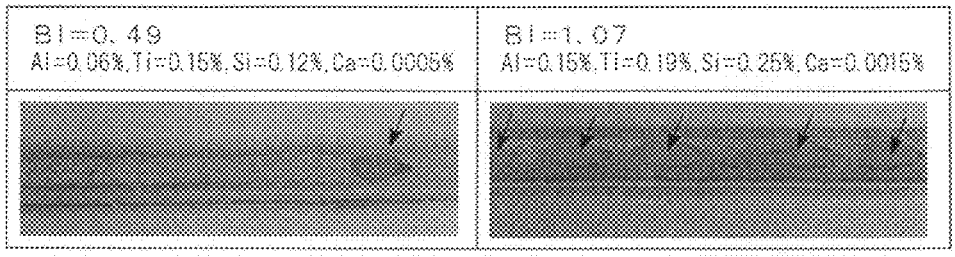
FIG. 1 includes photos showing the appearance of black spots generated on the rear side during TIG welding.
Figure 1:
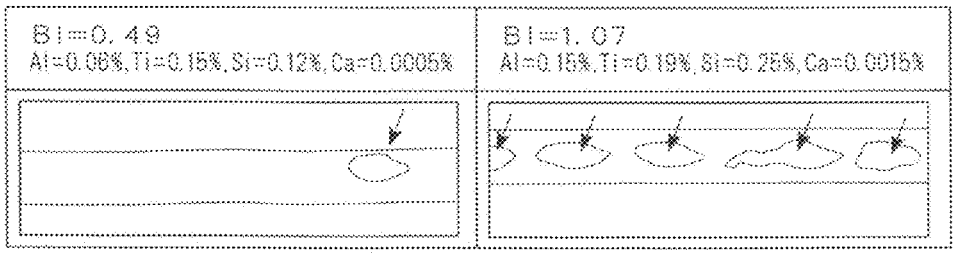

Hereinafter, the invention will be described in detail.

The ferrite stainless steel with low black spot generation in welded portions according to the present invention fulfills the following formula (1).

$$BI=3Al+Ti+0.5Si+200Ca\leq 0.8 \quad (1)$$

(wherein Al, Ti, Si, and Ca in formula (1) represent the contents of the respective components in the steel (mass %)).

Al, Ti, Si, and Ca have a particularly strong affinity to oxygen; and therefore, they are elements to generate black spots during TIG welding. In addition, the larger the amounts of Al, Ti, Si, and Ca present in a steel are, the more liable black spots are to occur. The coefficients of Al, Ti, Si, and Ca in the formula (1) are determined based on the degree of an action that accelerates the generation of black spots and the content thereof in the steel. More specifically, as shown in Examples described below, Al is contained at the highest concentration in black spots, and Al has a particularly strong action that accelerates the generation of black spots. Therefore, in the formula (1), the coefficient of Al is set to be 3. In addition, in spite of the low content in the steel, Ca is contained at a high concentration in the black spots, and Ca has a strong action that accelerates the generation of black spots. Therefore, the coefficient of Ca is set to be 200.

In the case where the BI value exceeds 0.8, black spots are remarkably generated. In contrast, in the case where the BI value is 0.8 or lower, the generation of black spots in TIG welded portions is sufficiently suppressed, and excellent corrosion resistance can be obtained. In addition, in the case where the BI value is 0.4 or lower, it is possible to suppress the generation of black spots more effectively, and more improvement in the corrosion resistance of TIG welded portions can be attained.

Next, the component composition of the ferrite stainless steel according to the present invention will be described in detail.

Firstly, the respective elements that define the formula (1) will be described.

Al is important as a deoxidation element, and Al also has an effect of controlling the compositions of non-metallic inclusions so as to refine the microstructure. However, Al is an element that makes the largest contribution to generation of black spots. In addition, an excessive amount of Al causes coarsening of non-metallic inclusions, and these non-metallic inclusions may act as starting points for generation of defects in a product. Therefore, the upper limit of the Al content is set to be in a range of 0.15% or less. For the purpose of deoxidation, it is preferable to include Al at a content within a range of 0.01% or more. The Al content is more preferably in a range of 0.03% to 0.10%.

Ti is an extremely important element from the standpoint of fixing C and N and suppressing inter-granular corrosion of welded portions so as to improve formability. However, an excessive amount of Ti generates black spots, and also causes surface defects during manufacturing. Therefore, the Ti content is set to be in a range of 0.05% to 0.5%. The Ti content is more preferably in a range of 0.07% to 0.35%.

Si is an important element as a deoxidation element, and Si is also effective for improvement in corrosion resistance and oxidation resistance. However, an excessive amount of Si accelerates the generation of black spots, and also degrades formability and manufacturability. Therefore, the upper limit of the Si content is set to be in a range of 1.0% or less. For the purpose of deoxidation, it is preferable to include Si at a content within a range of 0.01% or more. The Si content is more preferably in a range of 0.05% to 0.3%.

Ca is extremely important as a deoxidation element, and Ca is contained at an extremely small amount in a steel as a non-metallic inclusion. However, since Ca is extremely liable to be oxidized, Ca becomes a large cause for the generation of black spots during welding. In addition, there are cases where Ca generates water-soluble inclusions so as to degrade corrosion resistance. Therefore, it is desirable that the Ca content be reduced to an extremely small level, and the upper limit of the Ca content is set to be in a range of 0.0015% or less. The Ca content is more preferably in a range of 0.0012% or less.

Next, other elements that constitute the ferrite stainless steel according to the present invention will be described.

Since C degrades inter-granular corrosion resistance and formability, it is necessary to reduce the C content. Therefore, the upper limit of the C content is set to be in a range of 0.020% or less. However, since an excessive reduction of the C content increases refining costs, the C content is more preferably in a range of 0.002% to 0.015%.

Since N, similarly to C, degrades inter-granular corrosion resistance and formability, it is necessary to reduce the N content. Therefore, the upper limit of the N content is set to be in a range of 0.025% or less. However, since an excessive reduction of the N content degrades refining costs, the N content is more preferably in a range of 0.002% to 0.015%.

Mn is an important element as a deoxidation element. However, an excessive amount of Mn is liable to generate MnS which acts as a starting point for corrosion, and makes the ferrite structure unstable. Therefore, the Mn content is set to be in a range of 0.5% or less. For the purpose of deoxidation, it is preferable to include Mn at a content within a range of 0.01% or more. The Mn content is more preferably in a range of 0.05% to 0.3%.

Since P not only degrades weldability and formability but also makes inter-granular corrosion liable to occur, it is necessary to reduce the P content to a low level. Therefore, the P content is set to be in a range of 0.035% or less. The P content is more preferably in a range of 0.001% to 0.02%.

Since S generates water-soluble inclusions such as CaS, MnS, or the like which act as a starting point for corrosion, it is necessary to reduce the S content. Therefore, the S content is set to be in a range of 0.01% or less. However, an excessive reduction of the S content causes degradation in costs. Therefore, the S content is more preferably in a range of 0.0001% to 0.005%.

Cr is the most important element from the standpoint of securing corrosion resistance of a stainless steel, and it is necessary to include Cr at a content within a range of 16% or more so as to stabilize the ferrite structure. However, since Cr degrades formability and manufacturability, the upper limit is set to be in a range of 25% or less. The Cr content is preferably in a range of 16.5% to 23%, and more preferably in a range of 18.0% to 22.5%.

Due to its properties, Nb can be added solely or in combination with Ti. In the case where Nb is added with Ti, it is preferable to satisfy $(Ti+Nb)/(C+N) \geq 6$ (wherein the Ti, Nb, C, and N in the formula represent the contents of the respective components in the steel (mass %)).

Nb is, similarly to Ti, an element that fixes C and N and suppresses inter-granular corrosion of welded portions so as to improve formability. However, since an excessive amount of Nb degrades formability, the upper limit of the Nb content is preferably set to be in a range of 0.6% or less. In addition, in order to improve the above-described properties by containing Nb, it is preferable to include Nb at a content within a range of 0.05% or more. The Nb content is preferably in a range of 0.1% to 0.5%, and more preferably in a range of 0.15% to 0.4%.

Mo has an effect of repairing passivation films, and Mo is an extremely effective element for improvement in corrosion resistance. In addition, in the case where Mo is added with Cr, Mo has an effect of effectively improving pitting corrosion resistance. In addition, in the case where Mo is added with Ni, Mo has an effect of improving resistance to outflow rust (property to suppress outflow rust). However, an increase of the Mo content degrades formability and increases costs. Therefore, the upper limit of the Mo content is preferably set to be in a range of 3.0% or more. In addition, in order to improve the above-described properties by containing Mo, it is preferable to include Mo at a content within a range of 0.30% or more. The Mo content is preferably in a range of 0.60% to 2.5%, and more preferably in a range of 0.9% to 2.0%.

Ni has an effect of suppressing the rate of active dissolution, and in addition, Ni has a low hydrogen overvoltage. Therefore, Ni has excellent repassivation properties. However, an excessive amount of Ni degrades formability, and makes ferrite structure unstable. Therefore, the upper limit of the Ni content of is preferably set to be in a range of 2.0% or less. In addition, in order to improve the above-described properties by containing Ni, it is preferable to include Ni at a content within a range of 0.05% or more. The Ni content is preferably in a range of 0.1% to 1.2%, and more preferably in a range of 0.2% to 1.1%.

Cu, similarly to Ni, has an effect of lowering the rate of active dissolution, and Cu also has an effect of accelerating repassivation. However, an excessive amount of Cu degrades formability. Therefore, if Cu is added, the upper limit is preferably set to be in a range of 2.0% or less. In order to improve the above-described properties by containing Cu, it is preferable to include Cu at a content within a range of 0.05% or more. The Cu content is preferably in a range of 0.2% to 1.5%, and more preferably in a range of 0.25% to 1.1%.

V and Zr improve weather resistance and crevice corrosion resistance. In addition, in the case where V is added while the amounts of Cr and Mo are suppressed, excellent formability is also guaranteed. However, an excessive amount of V and/or Zr degrades formability, and also saturates the effect of improving corrosion resistance. Therefore, if V and/or Zr is added, then the upper limit of the content is preferably set to be in a range of 0.2% or less when. In order to improve the above-described properties by containing V and/or Zr, it is preferable to include V and/or Zr at a content within a range of 0.03% or more. The content of V and/or Zr is more preferably in a range of 0.05% to 0.1%.

B is a grain boundary strengthening element that is effective for improving secondary work embrittlement. However, an excessive amount of B strengthens matrix through solid-solution strengthening, and this strengthening causes a degradation in ductility. Therefore, if B is added, then the lower limit of the content is preferably set to be in a range of 0.0001% or less, and the upper limit of the content is preferably set to be in a range of 0.005% or less. The B content is more preferably in a range of 0.0002% to 0.0020%.

EXAMPLES

Test specimens consisting of ferrite stainless steels having the chemical components (compositions) shown in Tables 1 and 2 were manufactured in a method shown below. At first, cast steels having the chemical components (compositions) shown in Tables 1 and 2 were melted by vacuum melting so as to manufacture 40 mm-thick ingots, and then the ingots were subjected to hot rolling to be rolled into a thickness of 5 mm. After that, based on the recrystallization behaviors of the respective steels, thermal treatments were performed at a temperature within a range of 800° C. to 1000° C. for 1 minute, and then scales were removed by polishing. Subsequently, cold rolling was performed so as to manufacture 0.8 mm-thick steel sheets. After that, as a final annealing, thermal treatments were performed at a temperature within a range of 800° C. to 1000° C. for 1 minute based on the recrystallization behaviors of the respective steels, and then oxidized scales on the surfaces were removed by pickling; and thereby, test materials were produced. Using the test materials, test specimens Nos. 1 to 43 were manufactured.

Here, with regard to the chemical components (compositions) shown in Tables 1 and 2, the balance is iron and inevitable impurities.

TABLE 1

| No | C | Si | Mn | P | S | Cr | Al | Ti | Ca | N | Mo | Nb | Ni | Cu | B | V | Zr | |
|---|---|---|---|---|---|---|---|---|---|---|---|---|---|---|---|---|---|---|
| 1 | 0.011 | 0.12 | 0.30 | 0.023 | 0.002 | 19.4 | 0.06 | 0.20 | 0.0005 | 0.011 | | | | | | | | The Invention |
| 2 | 0.009 | 0.20 | 0.25 | 0.020 | 0.001 | 22.1 | 0.05 | 0.19 | 0.0006 | 0.009 | | | | | | | | The Invention |
| 3 | 0.013 | 0.30 | 0.21 | 0.032 | 0.001 | 16.9 | 0.07 | 0.21 | 0.0003 | 0.012 | | | | | | | | The Invention |
| 4 | 0.006 | 0.12 | 0.18 | 0.029 | 0.001 | 22.0 | 0.05 | 0.33 | 0.0004 | 0.008 | | | | | | | | The Invention |
| 5 | 0.010 | 0.32 | 0.25 | 0.032 | 0.002 | 19.1 | 0.06 | 0.11 | 0.0006 | 0.013 | | | | | | | | The Invention |
| 6 | 0.009 | 0.55 | 0.25 | 0.029 | 0.002 | 16.8 | 0.05 | 0.12 | 0.0005 | 0.009 | | 0.18 | | | | | | The Invention |
| 7 | 0.011 | 0.15 | 0.19 | 0.021 | 0.001 | 22.0 | 0.08 | 0.09 | 0.0003 | 0.012 | | 0.55 | | | | | | The Invention |
| 8 | 0.010 | 0.14 | 0.20 | 0.031 | 0.002 | 24.3 | 0.13 | 0.20 | 0.0006 | 0.013 | | 0.15 | | | | | | The Invention |
| 9 | 0.009 | 0.12 | 0.14 | 0.029 | 0.001 | 18.5 | 0.07 | 0.10 | 0.0011 | 0.009 | 0.35 | 0.02 | | | | | | The Invention |
| 10 | 0.006 | 0.10 | 0.18 | 0.022 | 0.001 | 22.1 | 0.05 | 0.12 | 0.0004 | 0.011 | 1.15 | 0.22 | | | | | | The Invention |
| 11 | 0.009 | 0.14 | 0.20 | 0.021 | 0.001 | 19.3 | 0.06 | 0.15 | 0.0005 | 0.010 | 1.05 | 0.20 | | | | | | The Invention |
| 12 | 0.007 | 0.10 | 0.18 | 0.022 | 0.001 | 19.4 | 0.08 | 0.15 | 0.0004 | 0.011 | 1.81 | 0.18 | | | | | | The Invention |
| 13 | 0.010 | 0.14 | 0.20 | 0.021 | 0.001 | 18.8 | 0.08 | 0.21 | 0.0005 | 0.010 | 0.95 | 0.01 | | | | | | The Invention |
| 14 | 0.009 | 0.11 | 0.22 | 0.022 | 0.001 | 17.9 | 0.08 | 0.20 | 0.0004 | 0.011 | 1.69 | 0.03 | | | | | | The Invention |
| 15 | 0.012 | 0.09 | 0.20 | 0.027 | 0.002 | 16.9 | 0.05 | 0.08 | 0.0006 | 0.012 | 1.00 | 0.21 | 0.32 | | | | | The Invention |
| 16 | 0.006 | 0.12 | 0.13 | 0.020 | 0.001 | 19.9 | 0.07 | 0.12 | 0.0008 | 0.009 | 1.06 | 0.22 | 1.05 | | | | | The Invention |
| 17 | 0.015 | 0.40 | 0.18 | 0.025 | 0.001 | 19.2 | 0.05 | 0.09 | 0.0003 | 0.011 | 0.05 | 0.39 | 0.26 | 0.35 | | | | The Invention |
| 18 | 0.008 | 0.19 | 0.15 | 0.023 | 0.002 | 21.5 | 0.04 | 0.21 | 0.0004 | 0.010 | 0.89 | 0.02 | 0.22 | 0.45 | | | | The Invention |
| 19 | 0.011 | 0.30 | 0.18 | 0.022 | 0.001 | 17.5 | 0.05 | 0.11 | 0.0003 | 0.012 | 1.92 | 0.31 | 0.15 | 0.31 | | | | The Invention |
| 20 | 0.013 | 0.25 | 0.22 | 0.024 | 0.002 | 19.7 | 0.04 | 0.16 | 0.0005 | 0.011 | 0.51 | 0.21 | | 0.55 | | | | The Invention |
| 21 | 0.013 | 0.16 | 0.11 | 0.025 | 0.001 | 22.6 | 0.07 | 0.09 | 0.0010 | 0.013 | 1.80 | 0.22 | | | 0.0008 | | | The Invention |
| 22 | 0.007 | 0.24 | 0.10 | 0.030 | 0.001 | 19.6 | 0.06 | 0.10 | 0.0009 | 0.011 | 1.01 | 0.25 | | | | | 0.21 | The Invention |

TABLE 2

| No | C | Si | Mn | P | S | Cr | Al | Ti | Ca | N | Mo | Nb | Ni | Cu | B | V | Zr | |
|---|---|---|---|---|---|---|---|---|---|---|---|---|---|---|---|---|---|---|
| 23 | 0.011 | 0.15 | 0.15 | 0.022 | 0.001 | 18.8 | 0.10 | 0.22 | 0.0003 | 0.010 | 1.99 | 0.21 | | | | 0.05 | | The Invention |
| 24 | 0.006 | 0.60 | 0.35 | 0.024 | 0.002 | 19.1 | 0.09 | 0.10 | 0.0006 | 0.009 | 1.30 | 0.29 | | | | 0.12 | | The Invention |
| 25 | 0.010 | 0.23 | 0.20 | 0.020 | 0.001 | 21.0 | 0.08 | 0.15 | 0.0009 | 0.009 | 0.61 | 0.22 | | | 0.0009 | 0.08 | 0.12 | The Invention |
| 26 | 0.008 | 0.15 | 0.17 | 0.031 | 0.001 | 19.9 | 0.05 | 0.13 | 0.0003 | 0.010 | 0.99 | 0.17 | 0.20 | | | 0.08 | | The Invention |
| 27 | 0.007 | 0.11 | 0.20 | 0.027 | 0.002 | 19.2 | 0.06 | 0.19 | 0.0005 | 0.011 | 0.87 | 0.20 | 0.30 | 0.34 | | 0.06 | | The Invention |
| 28 | 0.010 | 0.19 | 0.31 | 0.019 | 0.001 | 18.8 | 0.08 | 0.09 | 0.0006 | 0.009 | 1.32 | 0.28 | 0.27 | 0.45 | 0.0010 | 0.09 | | The Invention |
| 29 | 0.006 | 0.15 | 0.22 | 0.025 | 0.001 | 18.0 | 0.04 | 0.28 | 0.0003 | 0.012 | 1.22 | | | | | | | The Invention |
| 30 | 0.008 | 0.08 | 0.11 | 0.020 | 0.001 | 17.4 | 0.05 | 0.22 | 0.0004 | 0.015 | 1.09 | | | | 0.0011 | | | The Invention |
| 31 | 0.003 | 0.10 | 0.08 | 0.015 | 0.002 | 16.7 | 0.03 | 0.20 | 0.0005 | 0.008 | 1.11 | | | | 0.0009 | | | The Invention |
| 32 | 0.006 | 0.30 | 0.21 | 0.022 | 0.001 | 18.9 | 0.04 | 0.15 | 0.0004 | 0.011 | 1.81 | 0.21 | | | 0.0008 | | | The Invention |
| 33 | 0.017 | 0.49 | 0.25 | 0.025 | 0.001 | 19.5 | 0.06 | 0.09 | 0.0006 | 0.015 | | 0.35 | 0.32 | | | | | The Invention |
| 34 | 0.015 | 0.30 | 0.26 | 0.030 | 0.003 | 20.5 | 0.15 | 0.15 | 0.0012 | 0.009 | | 0.29 | 0.12 | | | 0.08 | | Comparative Example |
| 35 | 0.006 | 1.22 | 0.29 | 0.020 | 0.001 | 18.6 | 0.05 | 0.22 | 0.0003 | 0.010 | | | | | | | | Comparative Example |
| 36 | 0.011 | 0.19 | 0.16 | 0.030 | 0.001 | 19.6 | 0.25 | 0.14 | 0.0006 | 0.090 | | 0.26 | | | | | | Comparative Example |
| 37 | 0.012 | 0.20 | 0.19 | 0.029 | 0.002 | 22.0 | 0.08 | 0.55 | 0.0007 | 0.012 | 1.90 | 0.11 | | | | | | Comparative Example |
| 38 | 0.009 | 0.15 | 0.21 | 0.022 | 0.001 | 17.9 | 0.07 | 0.21 | 0.0019 | 0.011 | 0.91 | 0.20 | | | | | | Comparative Example |

TABLE 2-continued

| No | C | Si | Mn | P | S | Cr | Al | Ti | Ca | N | Mo | Nb | Ni | Cu | B | V | Zr | |
|---|---|---|---|---|---|---|---|---|---|---|---|---|---|---|---|---|---|---|
| 39 | 0.005 | 1.01 | 0.37 | 0.026 | 0.003 | 18.2 | 0.15 | 0.13 | 0.0003 | 0.008 | 1.92 | 0.26 | | | | | | Comparative Example |
| 40 | 0.011 | 0.31 | 0.21 | 0.031 | 0.001 | 21.1 | 0.12 | 0.30 | 0.0004 | 0.009 | 0.59 | 0.09 | | | | | | Comparative Example |
| 41 | 0.012 | 0.45 | 0.26 | 0.021 | 0.001 | 23.1 | 0.09 | 0.25 | 0.0015 | 0.010 | 0.99 | 0.24 | 0.29 | 0.65 | | | | Comparative Example |
| 42 | 0.010 | 0.21 | 0.16 | 0.022 | 0.001 | 14.3 | 0.05 | 0.20 | 0.0011 | 0.012 | | | | | | | | Comparative Example |
| 43 | 0.065 | 0.31 | 0.59 | 0.023 | 0.001 | 16.2 | 0.07 | 0.02 | 0.0005 | 0.030 | | | | | | | | Comparative Example |

The test specimens Nos. 1 to 43 obtained in the above-described manner were subjected to TIG welding under the welding conditions shown below. Then, total black spot length ratios were calculated by the method described below. In addition, with respect to the test specimens 1 to 43, corrosion tests shown below were performed.

(Welding Conditions)

TIG butt-welding specimens were made with same material under conditions where a feed rate was 50 cm/min and a heat input was in a range of 550 to 650 J/cm$^2$. For shielding, argon was used both for the torch side and the rear surface side.

(Total Black Spot Length Ratio)

Total black spot length ratio was obtained as a criterion that indicates the number (amount) of black spots generated after the TIG welding. The total black spot length ratio was obtained by calculating the sum of lengths in a welding direction of the respective black spots generated in a welded portion and dividing the sum of the lengths by the total length of the welded portion. Specifically, the total black spot length ratio was obtained in the following manner. About 10 cm of a welded portion was photographed using a digital camera, the lengths of the respective black spots were measured, and a ratio of the sum of the lengths of the black spots in the welded portion to the length of the welded portion was calculated by using an image processing.

(Corrosion Test)

Specimens were prepared by subjecting the TIG welded portions in the welding test specimens to bulging, and these were used as corrosion test specimens. The bulging was performed by setting the reverse sides of the welding test specimens as front surfaces and using a punch having a diameter of 20 mm under the Erichsen test conditions in conformity with JIS Z 2247. Here, in order to set the process conditions to the same, the test specimens were processed to have a bulged height of 6 mm by stopping the bulging in the middle of the processing. That is, the bulged heights were set to the same value of 6 mm. Corrosion resistance was evaluated by the following manner. Continuous spray tests of 5% NaCl were performed in conformity with JIS Z 2371, and then the presence of outflow rust was observed after 48 hours to evaluate the corrosion resistance by the presence or absence of outflow rust. Here, in the evaluation by the continuous spray tests of 5% NaCl, the corrosion resistance was evaluated to be "Good" in the case where no outflow rust were observed, and the corrosion resistance was evaluated to be "Bad" in the case where outflow rust occurred.

The above-described evaluation results are shown in Table 3.

TABLE 3

| No | BI | Generation length ratio (%) | Corrosion Test | |
|---|---|---|---|---|
| 1 | 0.54 | 35 | Good | The Invention |
| 2 | 0.56 | 25 | Good | The Invention |
| 3 | 0.63 | 41 | Good | The Invention |
| 4 | 0.62 | 39 | Good | The Invention |
| 5 | 0.57 | 25 | Good | The Invention |
| 6 | 0.65 | 31 | Good | The Invention |
| 7 | 0.47 | 26 | Good | The Invention |
| 8 | 0.78 | 40 | Good | The Invention |
| 9 | 0.59 | 11 | Good | The Invention |
| 10 | 0.40 | 0 | Good | The Invention |
| 11 | 0.50 | 27 | Good | The Invention |
| 12 | 0.52 | 14 | Good | The Invention |
| 13 | 0.62 | 32 | Good | The Invention |
| 14 | 0.58 | 29 | Good | The Invention |
| 15 | 0.40 | 10 | Good | The Invention |
| 16 | 0.55 | 31 | Good | The Invention |
| 17 | 0.50 | 9 | Good | The Invention |
| 18 | 0.51 | 36 | Good | The Invention |
| 19 | 0.47 | 16 | Good | The Invention |
| 20 | 0.51 | 22 | Good | The Invention |
| 21 | 0.58 | 20 | Good | The Invention |
| 22 | 0.58 | 20 | Good | The Invention |
| 23 | 0.66 | 40 | Good | The Invention |
| 24 | 0.79 | 39 | Good | The Invention |
| 25 | 0.69 | 27 | Good | The Invention |
| 26 | 0.42 | 12 | Good | The Invention |
| 27 | 0.53 | 25 | Good | The Invention |
| 28 | 0.55 | 21 | Good | The Invention |
| 29 | 0.54 | 19 | Good | The Invention |
| 30 | 0.49 | 15 | Good | The Invention |
| 31 | 0.44 | 8 | Good | The Invention |
| 32 | 0.50 | 10 | Good | The Invention |
| 33 | 0.64 | 25 | Good | The Invention |
| 34 | 0.99 | 71 | Bad | Comparative Example |
| 35 | 1.04 | 68 | Bad | Comparative Example |
| 36 | 1.11 | 74 | Bad | Comparative Example |
| 37 | 1.03 | 61 | Bad | Comparative Example |
| 38 | 0.88 | 64 | Bad | Comparative Example |
| 39 | 1.15 | 73 | Bad | Comparative Example |
| 40 | 0.90 | 83 | Bad | Comparative Example |
| 41 | 1.05 | 79 | Bad | Comparative Example |
| 42 | 0.68 | 30 | Bad | Comparative Example |
| 43 | 0.47 | 9 | Bad | Comparative Example |

As shown in Tables 1 to 3, in the test specimens Nos. 1 to 33 which had chemical components (compositions) within the ranges of the invention and had BI values of 0.8 or lower, total black spot length ratios were small; and therefore, a small number of black spots were generated after the TIG welding. Furthermore, even in the continuous spray tests of 5% NaCl for corrosion resistance test specimens which had been processed by an Erichsen tester, no rust was observed in the welded portions. Therefore, the corrosion resistance was "Good."

On the other hand, in the test specimens Nos. 34 to 41 which had BI values exceeding 0.8, total black spot length ratios were large after the TIG welding, and generation of rust was observed in the corrosion test.

In the test specimen No. 42 having a compositional ratio of Cr of less than 16% and the test specimen No. 43 having a compositional ratio of Ti of less than 0.05%, generation of rust was observed in the corrosion test.

In addition, the cross sections of the test specimens Nos. 34 to 43 were implanted in a manner that the rust-generated portions could be observed from a vertical direction, and then the rust-generated portions were observed by a microscope. As a result, separation of black spots was observed in starting points for corrosion.

Example 1

Test materials of ferrite stainless steels having the chemical components (compositions) shown below were manufactured in the same manner as the method for manufacturing the test specimen No. 1 except that 1 mm-thick steel sheets were manufactured through the cold rolling. Using the test materials, the test specimens A and B were obtained.

(Chemical Components (Compositions))

Test Specimen A

C: 0.007%, N: 0.011%, Si: 0.12%, Mn: 0.18%, P: 0.22%, S: 0.001%, Cr: 19.4%, Al: 0.06%, Ti: 0.15%, Ca: 0.0005%, the balance: iron and inevitable impurities Test Specimen B C: 0.009%, N: 0.010%, Si: 0.25%, Mn: 0.15%, P: 0.21%, S: 0.001%, Cr: 20.2%, Al: 0.15%, Ti: 0.19%, Ca: 0.0015%, the balance: iron and inevitable impurities The test specimens A and B obtained in the above-described manner were subjected to TIG welding under the same conditions as those for the test specimen No. 1, and the appearance of black spots generated on the rear sides during the TIG welding was observed.

The results are shown in FIG. 1.

FIG. 1(*a*) includes photos showing the appearance of black spots generated on the rear sides during the TIG welding. FIG. 1(*b*) includes schematic diagrams showing the appearance of black spots generated on the rear side during the TIG welding, which correspond to the photos shown in FIG. 1(*a*).

In FIGS. 1(*a*) and 1(*b*), the left side is a photo of the test specimen A having a BI value of 0.49, and the right side is a photo of the test specimen B having a BI value of 1.07.

In FIG. 1, as shown by the arrows, in both of the test specimen A having a BI value of 0.49 and the test specimen B having a BI value of 1.07, it was observed that patchy black spots were scattered. However, it was found that more black spots are generated in the test specimen B having a large BI value (the photo on the right side).

In addition, with respect to the test specimen B having a BI value of 1.07, Auger Electron Spectroscopy (AES) analysis was performed at two places of a weld bead zone and a black spot. The results are shown in FIG. 2.

Here, in the AES analysis, a field emission scanning auger electron spectroscopy was used, and the analysis was performed under conditions where an acceleration voltage was 10 key, a spot diameter was about 40 nm, and a sputter rate was 15 nm/min to a depth where the intensity of oxygen could hardly be observed. Meanwhile, since the size of AES analysis spot is small, the value of scale thickness by AES can vary slightly with measurement location. However, it is possible to compare the values among samples; and therefore, the AES analysis was adopted.

Figure 2:
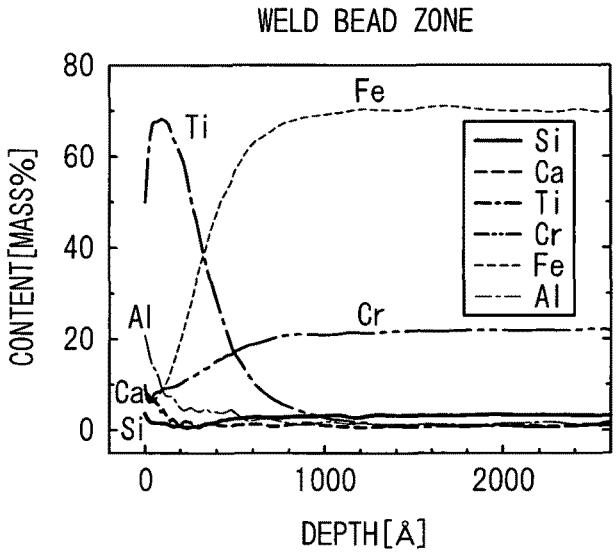
FIG. 2 includes graphs showing the results of the depth profiles of elements in a black spot and a weld bead zone on the rear side of a specimen which were measured by an AES.
Figure 2:
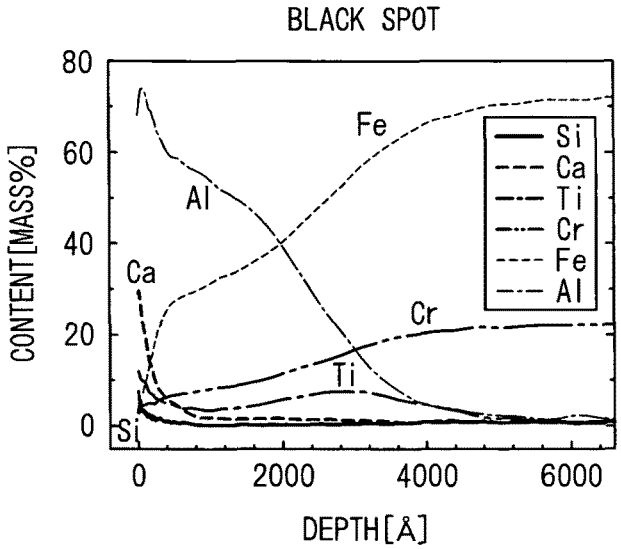

FIG. 2 includes graphs showing the results of the depth profiles of the elements (the concentration distribution of the elements in the depth direction) in the black spot and the weld bead zone on the rear side of the test specimen which were measured by the AES. FIG. 2(*a*) is the result at the weld bead zone, and FIG. 2(*b*) is the result at the black spot.

As shown in FIG. 2(*a*), the weld bead zone consisted of oxides which included Ti as the main component and also included Al and Si and had a thickness of several hundred angstroms. On the other hand, as shown in FIG. 2(*b*), the black spot consisted of thick oxides which included Al as the main component and also included Ti, Si, and Ca and had a thickness of several thousand angstroms. In addition, from the graph of the black spot shown in FIG. 2(*b*), it could be confirmed that Al was included at the highest concentration in the black spot, and Ca was included at a high concentration in the black spot despite the Ca content in the steel was low.

Example 2

Test materials of ferrite stainless steels having various chemical components (compositions) including C: 0.002% to 0.015%, N: 0.02% to 0.015%, Cr: 16.5% to 23%, Ni: 0% to 1.5%, Mo: 0% to 2.5%, as a basic composition, and differing contents of Al, Ti, Si, Ca, and the like, which are the main components of black spots were manufactured in the same manner as the method for manufacturing the test specimen A. Using the test materials, a plurality of test specimens were obtained.

The plurality of test specimens obtained in the above-described manner were subjected to TIG welding under the same welding conditions as those for the test specimen No. 1. Then, total black spot length ratios were calculated in the same manner as that for the test specimen No. 1.

The results showed a tendency that total black spot length ratios were increased as the contents of Al, Ti, Si, and Ca were increased. These elements have a particularly strong affinity to oxygen, and it was found that, among them, Al had a particularly large effect, and Ca had a large influence on black spots despite the Ca content in the steel was low. In addition, it was also found that Ti and Si similarly made a contribution to generation of black spots.

From the above finding, it was found that, in the case where large amounts of Al, Ti, Si, and Ca are added, black spots are highly likely to be generated even when shielding is performed, and, in particular, Al and Ti have a large influence on the generation of black spots.

With respect to each of the plurality of test specimens, BI value shown in the formula (1) below was calculated, and the relationship between the BI value and the total black spot length ratio was studied.

$$BI=3Al+Ti+0.5Si+200Ca\leq 0.8 \quad (1)$$

(wherein Al, Ti, Si, and Ca in the formula (1) represent the contents (mass %) of the respective components in the steel).

Figure 3:
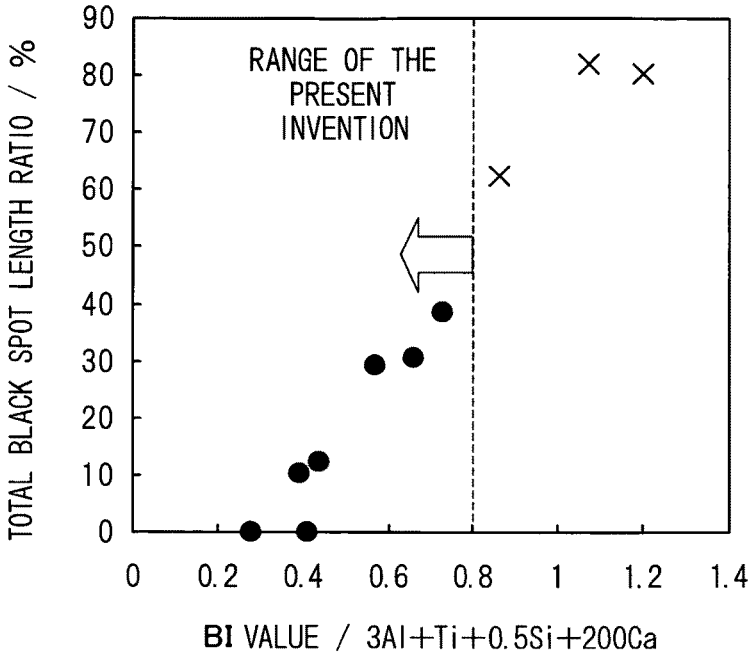
FIG. 3 is a graph showing the relationship between a BI value and a total black spot length ratio.

The results are shown in FIG. 3. FIG. 3 is a graph showing the relationship between the BI values and the total black spot length ratios. As shown in FIG. 3, it is found that, the larger the BI value is, the larger the total black spot length ratio becomes.

With respect to each of the plurality of test specimens, corrosion test was performed in the same manner as that for the test specimen No. 1. The results are also shown in FIG. 3. The '●' shown in the graph of FIG. 3 indicates the data of a test specimen in which no rust occurred in the corrosion test, and the 'x' indicates the data of a test specimen in which occurrence of rust was observed in the corrosion test. As shown in FIG. 3, in the case where the BI value exceeded 0.8, generation of rust was observed in the spray test.

From the above-described results, it was found that, in the ferrite stainless steel that is shown in FIG. 3 and fulfills the above-described formula (1), a generation amount of black spots is small in the TIG welded portions, and corrosion resistance is excellent.

INDUSTRIAL APPLICABILITY

The ferrite stainless steel of the present invention can be suitably used for members demanding corrosion resistance in structures formed by TIG welding for general indoor and outdoor use, such as exterior materials, construction materials, outdoor instruments, cold or hot water storage tanks, home appliances, bathtubs, kitchen utensils, drain water recovery equipment and heat exchangers of latent heat collection-type hot water supply systems, various welding pipes, or the like. In particular, the ferrite stainless steel of the present invention is suitable for members that are processed after TIG welding. In addition, since the ferrite stainless steel of the present invention has excellent formability of TIG welded portions as well as excellent corrosion resistance, the ferrite stainless steel can be widely applied to members that are difficult to process.

The invention claimed is:

1. A ferrite stainless steel with low black spot generation in welded portions, comprising: by mass %, C: 0.020% or less;
N: 0.025% or less;
Si: 0.25% or less;
Mn: 0.5% or less;
P: 0.035% or less;
S: 0.01% or less;
Cr: 19.1 to 22.6%;
Al: 0.04% to 0.13%;
Ti: 0.05% to 0.19%;
Ca: 0.0003% to 0.0015%;
either one or both of V: 0.05% to 0.2% and Zr: 0.05% to 0.2%; and
a balance of Fe and unavoidable impurities,
wherein the stainless steel has a BI value ≤0.8, and $$BI=3Al+Ti+0.5Si+200Ca.$$

2. The ferrite stainless steel with low black spot generation in welded portions according to claim 1, wherein the ferrite stainless steel further comprises, by mass %, Nb: 0.6% or less.

3. The ferrite stainless steel with low black spot generation in welded portions according to claim 1, wherein the ferrite stainless steel further comprises, by mass %, Mo: 3.0% or less.

4. The ferrite stainless steel with low black spot generation in welded portions according to claim 1, wherein the ferrite stainless steel further comprises, by mass %, either one or both of Cu: 2.0% or less and Ni: 2.0% or less.

5. The ferrite stainless steel with low black spot generation in welded portions according to claim 1, wherein the ferrite stainless steel further comprises, by mass %, B: 0.005% or less.

6. The ferrite stainless steel with low black spot generation in welded portions according to claim 2, further comprising at least one element selected from the group consisting of Mo: 3.0% or less, Cu: 2.0% or less, Ni: 2.0% or less, and B: 0.005% or less.

* * * * *

UNITED STATES PATENT AND TRADEMARK OFFICE

CERTIFICATE OF CORRECTION

PATENT NO. : 8,894,924 B2
APPLICATION NO. : 13/138237
DATED : November 25, 2014
INVENTOR(S) : Tooru Matsuhashi et al.

It is certified that error appears in the above-identified patent and that said Letters Patent is hereby corrected as shown below:

In the Specification

Column 1, line 58, change "portion is improved" to -- portion is improved. --;

Column 3, lines 24-25, change "Cr: 18.0% to 25%, Al: 0.03% to 0.15%" to -- Cr: 16% to 25%, Al: 0.15% or less, --;

Column 6, line 54, change "in a range of 0.2% or less when." to -- in a range of 0.2% or less. --.

Signed and Sealed this
Fourth Day of August, 2015

Michelle K. Lee

Michelle K. Lee
*Director of the United States Patent and Trademark Office*